US007038157B2

(12) United States Patent
Leusenkamp et al.

(10) Patent No.: US 7,038,157 B2
(45) Date of Patent: May 2, 2006

(54) VACUUM CIRCUIT BREAKER WITH COAXIAL COIL FOR GENERATING AN AXIAL MAGNETIC FIELD IN THE VICINITY OF THE CONTACT MEMBERS OF THE CIRCUIT BREAKER

(75) Inventors: Martin Bernardus Johannes Leusenkamp, Hengelo (NL); Johannes Hermannus Laurentius Antonius Hilderink, Haaksbergen (NL)

(73) Assignee: Eaton Electric N.V., Hengelo (NL)

( * ) Notice: Subject to any disclaimer, the term of this patent is extended or adjusted under 35 U.S.C. 154(b) by 0 days.

(21) Appl. No.: 10/476,612

(22) PCT Filed: May 2, 2002

(86) PCT No.: PCT/NL02/00294

§ 371 (c)(1),
(2), (4) Date: Nov. 3, 2003

(87) PCT Pub. No.: WO03/056591

PCT Pub. Date: Jul. 10, 2003

(65) Prior Publication Data

US 2004/0129681 A1 Jul. 8, 2004

(30) Foreign Application Priority Data

May 3, 2001 (NL) ..... 1017985

(51) Int. Cl.
*H01H 33/66* (2006.01)

(52) U.S. Cl. ..... 218/120; 218/140; 218/153

(58) Field of Classification Search ..... 218/118, 218/120, 140–143, 153, 154, 2–10, 14, 78, 218/84

See application file for complete search history.

(56) References Cited

U.S. PATENT DOCUMENTS

| | | | | |
|---|---|---|---|---|
| 4,661,665 | A * | 4/1987 | Carroll et al. | 218/141 |
| 4,661,666 | A * | 4/1987 | Sakuma et al. | 218/129 |
| 4,975,552 | A * | 12/1990 | Niegl et al. | 218/141 |
| 5,155,315 | A * | 10/1992 | Malkin et al. | 218/3 |
| 5,280,144 | A * | 1/1994 | Bolongeat-Mobleu et al. | 218/70 |
| 5,347,096 | A * | 9/1994 | Bolongeat-Mobleu et al. | 218/84 |
| 5,591,948 | A * | 1/1997 | Bolongeat-Mobleu et al. | 218/68 |
| 5,793,008 | A * | 8/1998 | Mayo et al. | 218/129 |
| 5,861,597 | A * | 1/1999 | Bolongeat-Mobleu et al. | 218/141 |
| 5,877,466 | A * | 3/1999 | Bolongeat-Mobleu et al. | 218/118 |

FOREIGN PATENT DOCUMENTS

| | | |
|---|---|---|
| EP | 0 709 867 | 5/1996 |
| EP | 0 794 545 | 9/1997 |
| EP | 0 840 339 | 5/1998 |

* cited by examiner

*Primary Examiner*—Lincoln Donovan
*Assistant Examiner*—M. Fishman
(74) *Attorney, Agent, or Firm*—Young & Thompson

(57) ABSTRACT

Vacuum circuit breaker, provided with a casing, in which a fixed and movable contact member are each attached to a supporting contact rod and supported therein in a mutually electrically isolated manner, and a coil coaxial to the casing and surrounding the contact members and having end connections. A first end connection of the coil is connected to one of the contact members. The contact member to which the first end connection of the coil is connected is coupled via a first coupling element to a feeder or outgoer connection of the vacuum circuit breaker. The second end connection of the coil is coupled via a second coupling element to the feeder or outgoer connection.

14 Claims, 2 Drawing Sheets

VACUUM CIRCUIT BREAKER WITH COAXIAL COIL FOR GENERATING AN AXIAL MAGNETIC FIELD IN THE VICINITY OF THE CONTACT MEMBERS OF THE CIRCUIT BREAKER

BACKGROUND OF THE INVENTION

The invention relates to a vacuum circuit breaker, provided with a casing, in which a fixed and a movable contact member are each attached to a supporting contact rod and supported therein in a mutually electrically isolated manner, and a coil coaxial to the casing and surrounding the contact members and having end connections, wherein a fast end connection is electrically connected to one of the contact members.

DESCRIPTION OF THE RELATED ART

A similar device is known from European patent application EP 0.709.867 A1. The advantage in this known device is that with the assistance of a shunt, not all of the current flows through the coil but only that part necessary to generate an axial magnetic field, enabling the coil to have smaller dimensions than in the situation where the coil must be able to conduct all of the current.

For that purpose, with the known vacuum circuit breaker, the first end connection of the coil is electrically connected to one of the contact members, for example, the fixed contact member, whilst the second end connection of the coil is arranged as a connection strip.

Between the ends of the two end connections is an electrically conductive shunt by which means only pat of the total current of the vacuum circuit breaker flows through the coil that generates an axial magnetic field at the point of the contact members. The shunt has impedance and can be a resistive element and is located between the end connections of the coil.

By using the shunt, the coil no longer functions along the lines of the known design of vacuum circuit breakers solely in series in the main current path of the vacuum circuit breaker, but the shunt is connected in parallel so that only a part of the main current flows through the coil. This enables dissipation losses in the coil to remain limited.

Because the coil itself has little electrical impedance, the shunt will require only relatively low impedance to achieve the desired effect, i.e. limitation of the main current through the coil, and therefore the dimensions of the shunt can be made small. According to internationally agreed standards, vacuum circuit breakers must, however, also be momentary, in other words, able to withstand a continuous short-circuit current of 10 to 80 kA for 1 to 3 seconds. Owing to the amount of heat generated in a very short time due to the large current, the shunt must have a certain thermal capacity. In order to meet this, the shunt must, from to known vacuum circuit breaker in EP 0.709.867A1, also have large axial dimensions to meet the necessary standard for the required thermal capacity. This results in the disadvantage that the end connections of such coils must be placed far apart, which results in the coil occupying more space in the axial direction at the position of the end connections. Owing to the forces occurring with a short-circuit current, the connection conductors must therefore also be robust, resulting in yet more loss of space.

An additional requirement that the shunt must meet is that the change in resistance resulting from a change in temperature must be equal to the change in resistance that occurs in the coil as a result of a change in coil temperature. This is necessary to ensure that the relationship between the current through the coil and the current through the shunt always remains the same or roughly the same, not only in the event of gradual changes in the ambient temperature that will affect the coil and the shunt equally, but also in the event of abrupt and large temperature differences between coil and shunt. In practice, it seems that with a continuous short-circuit current, the temperature change in the shunt is considerably higher than the temperature change in the coil. This is caused, in particular, by the total thermal capacity of the coil being larger than that of the shunt, so the coil is more easily able to absorb the heat generated by the short-circuit current than the shunt. The difference in temperature appears, in practice, to be considerable and can be more than 100° C. The choice of material for the shunt must therefore meet a number of requirements simultaneously, thus limiting the options considerably. With the device in European patent application EP 0.709.867 A1 there is the additional restriction that results from the physical positioning between the end connections of the coil.

SUMMARY OF THE INVENTION

It is an object of the invention to provide a vacuum circuit breaker of the type mentioned in the introduction with solutions to the abovementioned disadvantages.

According to the invention this object is achieved by the following means. The contact member to which the first end connection of the coil is connected is coupled via a first coupling element to a feeder or outgoer connection of the vacuum circuit breaker, and the second end connection of the coil is coupled via a second coupling element to the feeder or outgoer connection. The resistance of the first and second coupling element are set in order to achieve a desired current through the coil.

The advantage of the invention is that the shunt no longer needs to be physically present between the end connections of the coil, so more parameters for adjusting the current through the coil can be used, enabling more freedom in the dimensioning of the coil and therefore increased flexibility. This allows for better adjustment of the current-generated magnetic field to the desired optimum strength. From the literature (including the article "Interaction between a vacuum arc and an axial magnetic field" by H. C. W. Gundlach and included in the Proceedings $8^{th}$ Int. Symposium Discharges and Electrical Insulation in Vacuum", held in Albuquerque, U.S.A., Sep. 5–7, 1978 p. A2-1–11/see FIG. 2 and the article "Vacuum arc under an axial magnetic field and its interrupting ability" by S. Yanabu et al. published in Proc. IEE Vol. 126, No. 4, April 1979/see FIG. 4, 5 and 6) it is known that, depending upon several parameters, for favourable operation on the interrupting ability of a vacuum circuit breaker, there is an optimum vale of magnetic field. Higher and lower values reduce this favourable operation. In general, the optimum value lies between 3 and 10 mT per kA.

In order to guarantee that the set resistances result in a current in the coil which produces the desired optimum magnetic field even with the temperature changes and differences to be expected during operation, the materials of the first and second coupling elements and the coil must be such that they are resistive so that the set relationship between the resistances of the first and second coupling elements and coil remain the same or almost the same even with the large temperature changes and differences to be expected.

Preferably, the first and second coupling elements and the coil materials are chosen such that the set relationship between the resistances of the first and second coupling elements and the coil exhibits the same or almost the same change in resistance for the temperature changes which occur both during working-current conditions and with fault-current conditions.

BRIEF DESCRIPTION OF THE DRAWINGS

Further embodiments of the invention are described in the dependent claims.

The invention will be explained further by means of drawings in which.

Table 1 gives the data measured during a practical test of a switch.

DESCRIPTION OF THE PREFERRED EMBODIMENTS

Figure 1:
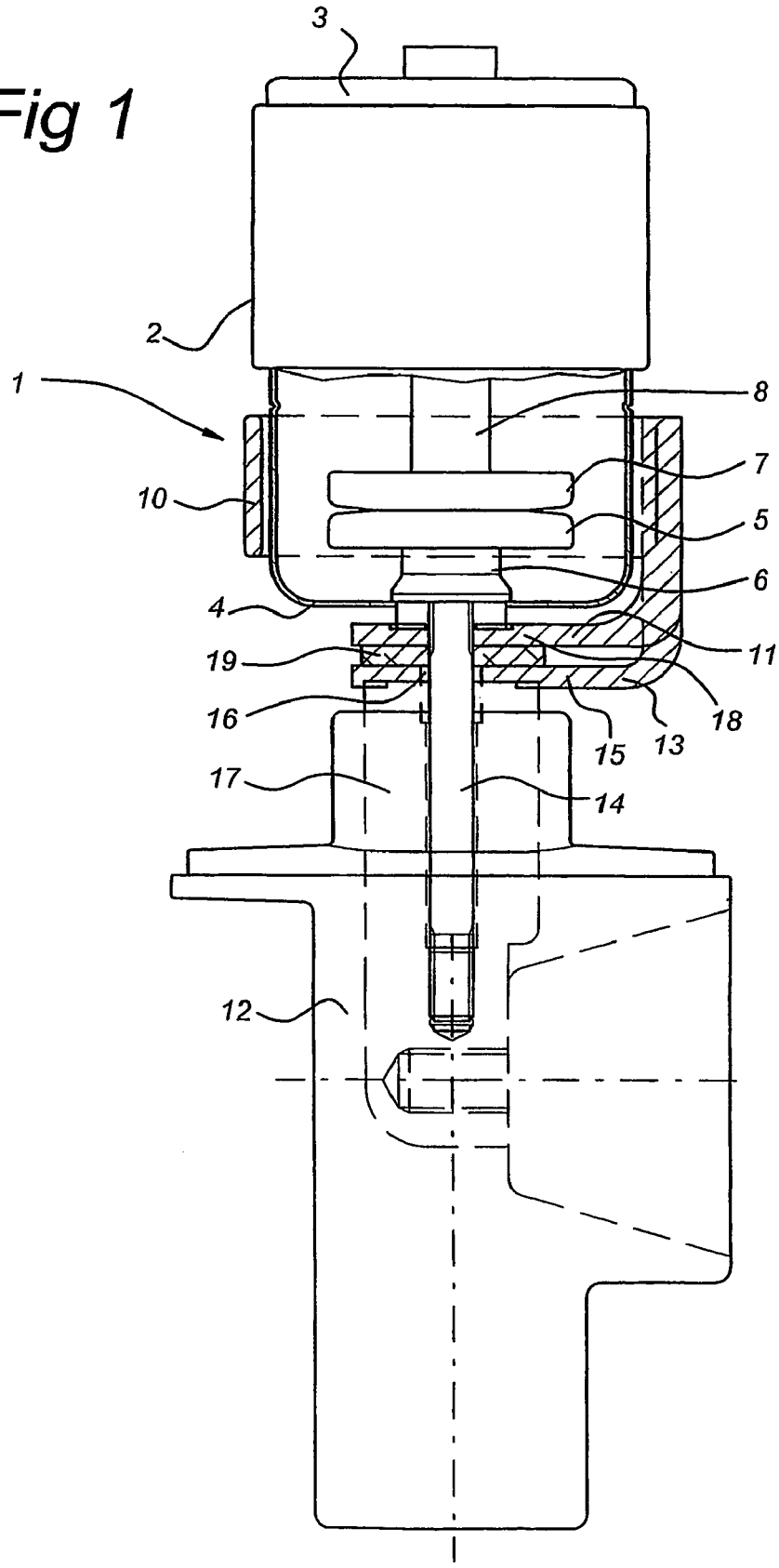
FIG. 1 shows a cross-section of a preferred vacuum circuit breaker to be used according to the invention in partial cross-section.

The cross-section of the embodiment displayed in FIG. 1 is an example of a certain type of vacuum switch; however, the invention can also be applied to every other type of switch, in which an axial field is applied to improve the arcing behaviour of the switch.

The connection set-up shown in FIG. 1 includes a vacuum tube 1, comprising an encasement 2 which is closed off by two end walls 3 and 4 situated opposite each other.

The fixed contact member 5 is fastened to and forms an electrically conductive connection with contact rod 6. This contact rod 6 is fixedly supported in the end wall 4 of vacuum tube 1. The movable contact member 7 is fastened to and forms an electrically conductive connection with the contact rod 8 which is supported such that it can move in the vacuum tube 1.

The connection set-up shown includes, moreover, a coil 10, of which one end connection 11 is electrically connected to the contact rod 6 of the fixed contact member 5.

The vacuum circuit breaker furthermore forms an electrically conductive connection with a feeder or outgoer connection 12 with which the vacuum circuit bier can be incorporated in an electrical circuit. The other of these connections is not shown and is connected to the movable contact rod 8.

The contact rod 6 of the fixed contact member 5 forms, via a first coupling element, which has the form of a rod 14 in FIG. 1, an electrically conductive connection with the feeder or outgoer connection 12.

The other end connection 13 of coil 10 is, in principle, coupled via a second coupling element to the feeder or outgoer connection 12. This coupling element can be a strip, for example, or can have another form.

When the vacuum circuit breaker with coil 10 has to be incorporated in an electrical circuit, this electrical circuit is connected on one side to connection 12 and on the other side to the connection on the upper contact rod 8, not shown. The main current path is from connection 12 via the first coupling element (for example rod 14), the fixed contact member 5, the movable contact member 7 and the movable contact rod 8 to the connection, not shown, on the upper contact rod 8 of the vacuum circuit breaker. The vacuum circuit breaker is opened because the upper movable contact rod 8 moves upward, separating contacts 5 and 7. Between the two contact members 5 and 7, an arc is then created and part of the main current to be interrupted subsequently flows from connection 12 over the first coupling element, the fixed contact member 5, the arc created, the movable contact member 7 and the movable contact rod 8 to the other connection of the vacuum circuit breakers From connection 12, another part of the main current runs over a second current path via the second coupling element, end connection 13 of the coil, coil 10, end connection 11 of the coil, contact rod 6 and subsequently joins the main current path mentioned earlier. The current flowing through the coil generates an axial magnetic field at the contact members 5 and 7. As known from the above articles, the axial magnetic field has an optimum value and it is the intention for the current flowing through the coil to be such that the axial magnetic field approaches this optimum value as closely as possible. The resistances of the first and second coupling elements are therefore chosen to ensure that the current flowing through the coil is such that the desired axial field of optimum strength is obtained. Compared with the known switch, the second coupling element provides an additional possibility of sending the right amount of current through the coil and therefore creating an optimum magnetic field.

In another embodiment (not shown), the end section 15 of the second end connection 13 runs transversely to the first coupling element, for example rod 14, but ends before this rod 14, so that the said end section 15 does not make contact with rod 14. In the embodiment which is not show, the second coupling element can be incorporated between the said transverse end section 15 of the second end connection 13 of coil 10 and connection 12, so that these three components, i.e. end section 15, second coupling element (for example in the form of a strip, rod or such like) and connection 12, can be pressed into conductive contact with one another by any suitable means.

In the preferred embodiment to be used shown in FIG. 1, the transverse end section 15 of the second end connection 13 of the coil 10 extends beyond rod 14. The transverse end section 15 and rod 14 must not come into contact with each other, so therefore end section 15 of second end connection 13 of coil 10 has a hole 16 through which rod 14 passes and is thereby insulated. The second coupling element has the form of a bush 17 which is arranged coaxially with and insulated from rod 14 and which can be a moulded piece. In the preferred embodiment to be used from FIG. 1, rod 14 is a tie bar which is electrically connected on one end to the contact rod 6 and on the other end is connected to the connection 12 such that the contact rod 6, the end section 18 of the end connection 11 of the coil 10, an insulating layer 19 which can be an insulating washer, the end section 15 of the second end connection 13 of the coil 10, the second coupling element of bush 17 and the connection 12 are pushed together and onto each other with an electrical contact pressure of sufficient strength. Here, rod 14 fulfils a combined electrical and mechanical function. In addition, this design embodiment has the advantage hat the first coupling element 14 is concentrically arranged in relation to the second coupling element, allowing use to be made of the so-called 'skin effect' whereby large currents, in particular, will flow along the outer edge of a conductor. Thus, this can also be used to influence the current distribution through the coil.

The equivalent circuit between the fixed contact member 5 and connection. 12 consists of a parallel circuit formed by the impedances of tie bar 14 and the impedance of coil 10 and the second coupling element or bush 17 connected in series. The invention makes it possible to choose from a large number of parameters in order to set the current through the coil at an optimum value to create an optimum axial magnetic field. These parameters are the material of the tie bar 14, the material of coaxial coupling element 17, coil 10, the length and cross-sectional dimensions of tie bar 14, coaxial coupling element 17 and coil 10.

Table 1 gives the data recorded in a practical test of a switch. This relates to a switch which, according to internationally set standards, must be able to resist a continuous short-circuit current of 16 kA for 1 second. In the choice of material for coil 10, tie bar 14 and coupling element 17, account has also been taken of the influence of changes in temperature on the resistance and the effect thereof on the interrelationship of the currents through coil 10, tie bar 14 and coupling element 17. From the available materials used in practice, a copper alloy has been chosen for coil 10 and coupling element 17 and a brass alloy for tie bar 14. It is, of course, also possible to use completely different materials as long as these meet the requirement that changes in resistances resulting from swings in ambient temperature and changes in temperature as a result of load or fault currents do not or hardly influence the relationship of the currents through coil 10, tie bar 14 and coupling element 17.

For the test, three operational situations were used, namely a minimum operating temperature of −40° C., nominal operating temperature of 20° C. and a maximum operating temperature of 105° C. Subsequently, in all three of these situations, a fault-current situation was simulated in which a current of 16 kA was conducted through the switch for 1 second.

From the minimum operating temperature, the fault current appeared to cause an increase in temperature of 118.2° C. in tie bar 14 and an increase of 26.3° C. in coil 10. This temperature difference caused a deviation m the current relationship of 4.5% so that the initial field strength of the axial magnetic field of 6.5 mT per kA was found to have risen to 6.8 mT per kA.

Based on the nominal operating temperature, the rise in temperature was found to be 146° C. and 29.2° C., respectively, so that the initial optimum field strength of the axial magnetic field of 5.9 was found to have increased to 6.3 mT per kA.

Finally, the temperature increase measured from the maximum operating temperature was 184° C. and 33° C., respectively, with an increase of the axial magnetic field from 5.3 to 5.8 mT per kA.

From these measurements, it can be deduced that the optimum axial magnetic field set for the nominal operating temperature to 5.9 mT per kA only deviated by 0.6 mT per kA or by approx. 10% from the optimum value dog the variation from minimum to maximum operating temperature. In the fault-current situations, the deviation was found to vary from 0.1 to 0.9 mT per kA, i.e. a maximum deviation of approx. 15%. The conclusion drawn from this is that the deviations in the actual magnetic field generated in relation to the optimum magnetic field have remained within acceptable limits in all situations.

Because a phase shift between the current through the coil and the current through the switch also influences the axial magnetic field, this was also looked at during the measurements. It was found that there is hardly any phase shift so that there is no negative influence on the optimum axial magnetic field.

Because only an insulating layer 19 has to be applied between the end connections 11, 13 of coil 10, the distance between those end connections is only the thickness of the insulating layer 19. Depending on the material of this insulating layer, this need only be a few millimetres. Another advantage is at it is now possible to use a spring washer in this location as well, which can absorb any expansion differences. Since the measurement has shown that short-term temperature differences which can amount to 200° C. can occur under fault-current conditions, expansion differences can also be considerable. With the known switch, a spring washer cannot readily be used in this location because a current runs between the ends of the coil which causes the aforementioned high temperature increase, thereby affecting the resilient properties of the spring washer.

It should be noted that in the invention, the shunt is not physically located between the end connections 11, 13 of coil 10 but outside them. This has the advantage that the dimensions of coil 10 are not influenced thereby that the choice of dimensions of the shunt can be selected for optimum resistance, temperature coefficient and heat absorption ability. Although the first coupling element 14 in the embodiment shown has been fitted completely outside vacuum tube 1, the invention is not limited thereto. For example, if the design of the vacuum tube allows it, it is also possible to fit the coupling element partially or completely in the vacuum tube, thus allowing the axial dimensions to be reduced.

Figure 2:
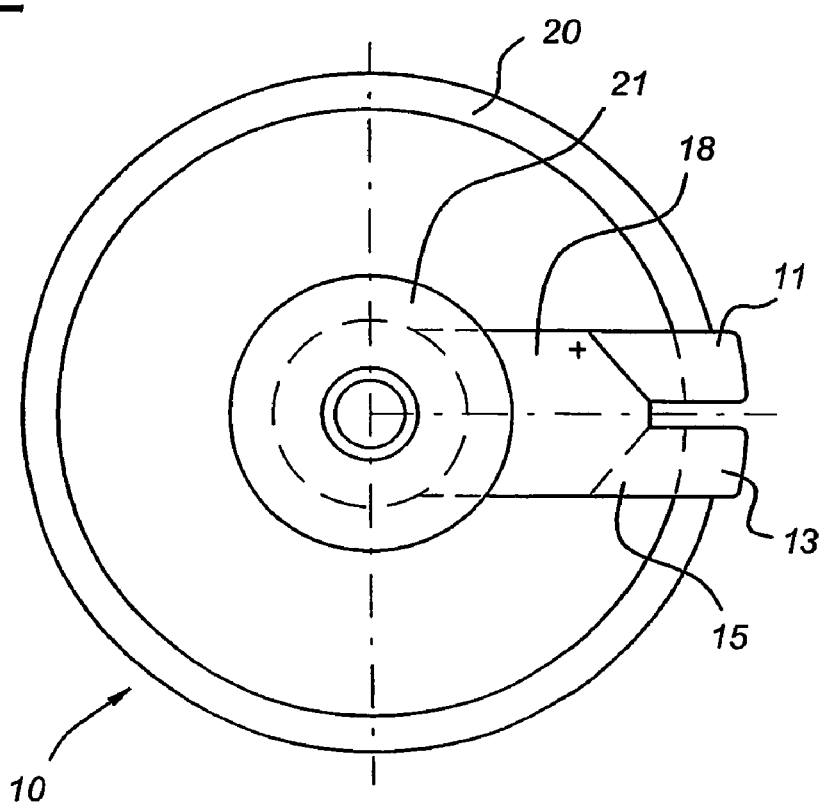
FIG. 2 is a bottom view of the coil shown in FIG. 1.
Figure 3:
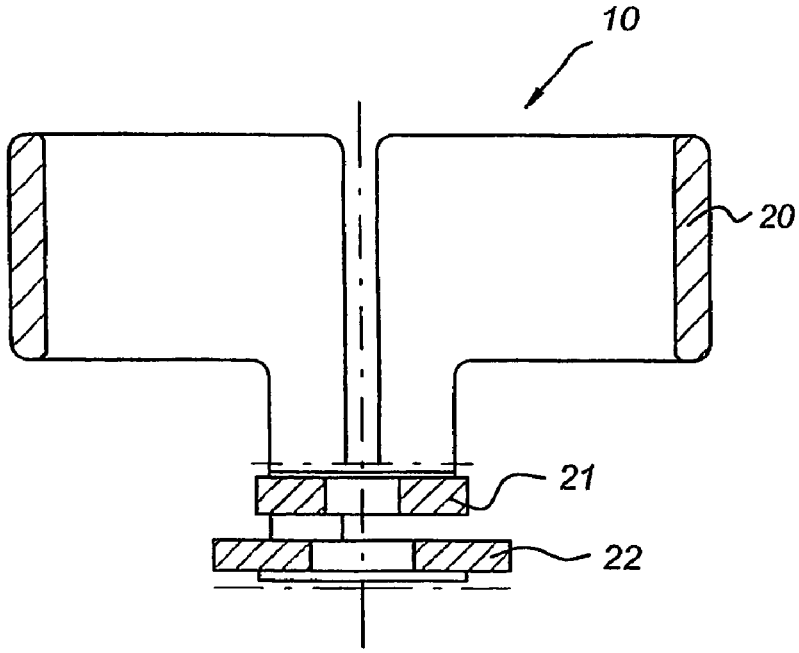
FIG. 3 shows a cross-section through the coil of FIG. 2.

FIG. 2 shows a bottom view of coil 10 and FIG. 3 depicts a cross-section of this coil.

As indicated, the coil consists of one turn 20. However, the coil can also have more turns or consist of a number of partial turns which form one or more turns. The coil is provided with end connections 11 and 13 having turn(s) 20 running perpendicular to end sections (18 and 15 respectively), which open out into rings 21 and 22.

The invention claimed is:

1. A vacuum circuit breaker, comprising:

a casing (2), in which a fixed and a movable contact member (5, 7) are each attached to a supporting contact rod and supported therein in a mutually electrically isolated manner, and a coil (10) coaxial to the casing and surrounding the contact members and having first and second end connections (11, 13), wherein the first end connection (11) is electrically connected to one of the contact members, the contact member to which the first end connection (11) of the coil (10) is connected is electrically coupled via a first electrical coupling element to a connection (12) of the vacuum circuit breaker, and the second end connection (13) of the coil (10) is electrically coupled via a second electrical coupling element to the connection (12), the resistances of the first and second coupling element are set in order to achieve a predetermined current value through the coil, the first and second coupling elements providing two separate electrical paths to the connection, a first electric path via the first end connection and the first coupling element, and a separate, second electrical path via the second end connection and the second coupling element, the connection (12) being for one of a feeder connection and an outgoer connection.

2. The vacuum circuit breaker according to claim 1, wherein the material of the first and second coupling elements has a resistance which, during the temperature differences which occur both during working-current conditions and with short-circuit current conditions, exhibits the at least approximately the same change in resistance as the resistance of the coil for the same temperature differences.

3. The vacuum circuit breaker according to claim 1, wherein the end section (15) of the second end connection (13) runs transversely to but does not make contact with the first coupling element, which runs parallel to the center line of the vacuum circuit breaker, and wherein the second coupling element also extends parallel to the center line of the vacuum circuit breaker and with one end adjoins the transverse end section (15) of the second end connection (13).

4. The vacuum circuit breaker according to claim 3, wherein the first coupling element is a rod (14), the transverse end section (15) of the second end connection (13) extends beyond the rod (14) and has a hole (16) through which the rod (14) extends and is thereby insulated and the second coupling element is arranged coaxially with and insulated from the rod, the second coupling element being a coaxial coupling element (17).

5. The vacuum circuit breaker according to claim 4, wherein the rod (14) is a tie bar which pushes together with sufficient pressure the contact rod (6) which bears the contact member (5) which is connected to first end connection (11), an end section (18) which runs transversely to the rod (14) of the first end connection (11) of the coil (10), an insulating layer (19), the transverse end section (15) of the second end connection (13) of the coil (10), the coaxial coupling element (17) and the connection (12).

6. The vacuum circuit breaker according to claim 5, wherein an electrically insulated spring washer is added between the end sections (15, 18) of the end connections (13, 11) of coil (10).

7. The vacuum circuit breaker according to claim 5, characterized in that the current through the coil is set by choosing at least one of the length, cross-sectional dimensions of the tie bar (14), and coaxial coupling element (17), or the material thereof.

8. The vacuum circuit breaker according to claim 7, characterized in that, with temperature changes resulting from the working-current and fault-current conditions, the material of tie bar (14) and coaxial coupling element (17) undergoes a change in resistance, differing by a maximum of 15% from the resistance of the coil under the same working-current and fault-current conditions.

9. The vacuum circuit breaker according to claim 2, wherein the end section (15) of the second end connection (13) runs transversely to but does not make contact with the first coupling element, which runs parallel to the center line of the vacuum circuit breaker, and wherein the second coupling element also extends parallel to the center line of the vacuum circuit breaker and with one end adjoins the transverse end section (15) of the second end connection (13).

10. The vacuum circuit breaker according to claim 6, characterized in that the current through the coil is set by choosing at least one of the length, cross-sectional dimensions of the tie bar (14), and coaxial coupling element (17), or the material thereof.

11. A vacuum circuit breaker, comprising:

a casing (2) having a fixed contact member and a movable contact member each attached to a supporting contact rod and supported therein in a mutually electrically isolated manner;

a coil (10) coaxial to the casing and surrounding the fixed and movable contact members, the coil having first and second end connections (11, 13), the first end connection (11) electrically connected to one of the contact members; and first and second electrical coupling elements, the one contact member to which the first end connection (11) of the coil (10) is connected, being electrically coupled via a first electrical coupling element to a circuit breaker connection (12), and the second end connection (13) of the coil (10) being electrically coupled via the second electrical coupling element to the circuit breaker connection (12), the resistances of the first and second coupling element set in order to achieve a predetermined current value through the, the first and second coupling elements providing two separate electrical paths to the connection, a first electric path via the first end connection and the first coupling element, and a separate, second electrical path via the second end connection and the second coupling element, the circuit breaker connection (12) being for one of a feeder connection and an outgoer connection.

12. The breaker of claim 11, wherein, the predetermined current flowing through the coil and a strength of a magnetic field of the coil is adjustable by selecting the resistances of the coupling elements.

13. A vacuum circuit breaker, comprising:

a casing (2) having a fixed contact member and a movable contact member each attached to a supporting contact rod and supported therein in a mutually electrically isolated manner;

a coil (10) coaxial to the casing and surrounding the fixed and movable contact members, the coil having first and second end connections (11, 13), a first end connection (11) is connected to one of the contact members; and first and second coupling elements, the one contact member to which the first end connection (11) of the coil (10) is connected, being coupled via a first coupling element to a feeder line connection (12), and the second end connection (13) of the coil (10) being coupled via the second coupling element to the feeder line connection (12), the resistances of the first and second coupling element set in order to achieve a predetermined current value through the coil, the first and second coupling elements providing two separate electrical paths to the connection, a first electric path via the first end connection and the first coupling element, and a separate, second electrical path via the second end connection and the second coupling element.

14. The breaker of claim 13, wherein, the predetermined current flowing through the coil and a strength of a magnetic field of the coil is adjustable by selecting the resistances of the coupling elements.

* * * * *